United States Patent [19]

Sato

[11] Patent Number: 4,696,274

[45] Date of Patent: Sep. 29, 1987

[54] FUEL INJECTION CONTROL FOR INTERNAL COMBUSTION ENGINE

[75] Inventor: Kunihiko Sato, Okazaki, Japan

[73] Assignee: Toyota Jidosha Kabushiki Kaisha, Toyota, Japan

[21] Appl. No.: 880,348

[22] Filed: Jun. 25, 1986

Related U.S. Application Data

[63] Continuation of Ser. No. 689,815, Jan. 8, 1985, abandoned.

[30] Foreign Application Priority Data

Aug. 7, 1984 [JP] Japan ..... 59-164189

[51] Int. Cl.[4] ..... F02B 3/00

[52] U.S. Cl. ..... 123/440; 123/489

[58] Field of Search ..... 123/440, 489

[56] References Cited

U.S. PATENT DOCUMENTS

| | | | |
|---|---|---|---|
| 3,831,564 | 8/1974 | Schmidt | 123/440 |
| 3,875,907 | 4/1975 | Wessel | 123/440 |
| 3,900,012 | 8/1975 | Wahl | 123/440 |
| 4,153,022 | 5/1979 | Asano | 123/440 |
| 4,170,965 | 10/1979 | Aono | 123/440 |
| 4,214,558 | 7/1980 | Nishioka | 123/489 |
| 4,227,507 | 10/1980 | Takase | 123/492 |
| 4,240,389 | 12/1980 | Shimazaki | 123/440 |
| 4,364,358 | 12/1982 | Shikata | 123/440 |
| 4,399,790 | 8/1983 | Kataoka | 123/440 |
| 4,501,242 | 2/1985 | Niimi | 123/440 |

*Primary Examiner*—Ronald B. Cox

*Attorney, Agent, or Firm*—Cushman, Darby & Cushman

[57] ABSTRACT

Fuel injection is adjusted in accordance with an air-fuel reation feedback correction coefficient which is calculated in accordance with a concentration of a specific compound in the exhaust gas of an engine. At least one of the amplitude and frequency of the air-fuel ratio feedback correction coefficient is controlled in accordance with the intake air flow of the engine.

3 Claims, 14 Drawing Figures

FUEL INJECTION CONTROL FOR INTERNAL COMBUSTION ENGINE

This is a continuation of application Ser. No. 689,815 filed Jan. 8, 1985 which was abandoned upon the filing hereof.

BACKGROUND OF THE INVENTION

1. Field of the Invention

The present invention relates to a method and an apparatus for controlling the fuel injection of an internal combustion engine by air-fuel ratio feedback correction.

2. Description of the Related Art

The air-fuel ratio feedback control technique, wherein an air-fuel ratio feedback correction coefficient is calculated in accordance with detection signals from a concentration sensor for detecting the concentration of a specific component in the exhaust gas, for example, an oxygen concentration sensor for detecting the concentration of the oxygen component (below, "$O_2$ sensor"), and using this correction coefficient to correct the fuel injection to the engine so as to control the engine air-fuel ratio to the desired value, is well known. By such air-fuel ratio feedback control, the air-fuel ratio state of the exhaust gas flowing into the 3-way catalytic converter is adjusted and the exhaust gas cleaning characteristics controlled to the most appropriate values.

When such air-fuel ratio feedback control is effected, there is a variable frequency and amplitude of the air-fuel ratio feedback correction coefficient maximizing the cleaning characteristics of the 3-way catalyst. However, the feedback frequency and amplitude of the air-fuel ratio correction coefficient change in accordance with the exhaust gas flow at that time. In the prior art, this feedback control frequency and amplitude have not been controlled at all, and therefore, it has not been possible to maintain the cleaning performance at its maximum level under all running conditions.

SUMMARY OF THE INVENTION

It is, therefore, an object of the present invention to provide a method and an apparatus for fuel injection control in which the maximum cleaning characteristics of the catalyst under all running conditions are obtained.

According to an aspect of the present invention, there is provided a method for fuel injection control for an internal combustion engine including the steps of: detecting a concentration of a specific component in an exhaust gas of the engine; calculating an air-fuel ratio feedback correction coefficient in accordance with the detected concentration of the specific component; adjusting the fuel injection to the engine in accordance with the calculated air-fuel ratio feedback correction coefficient; detecting an intake air flow of the engine; and controlling at least one of the amplitude and frequency of said air-fuel ratio feedback correction coefficient in accordance with the detected intake air flow.

According to another aspect of the present invention, there is provided an apparatus including a unit for detecting a concentration of a specific component in an exhaust gas of an engine, a unit for calculating an air-fuel ratio feedback correction coefficient in accordance with the detected concentration of the specific component, a unit for adjusting the fuel injection to the engine in accordance with the calculated air-fuel ratio feedback correction coefficient, a unit for detecting an intake air flow of the engine, and a unit for controlling at least one of the amplitude and frequency of the air-fuel ratio feedback correction coefficient in accordance with the detected intake air flow.

DESCRIPTION OF THE PREFERRED EMBODIMENTS

Figure 1:
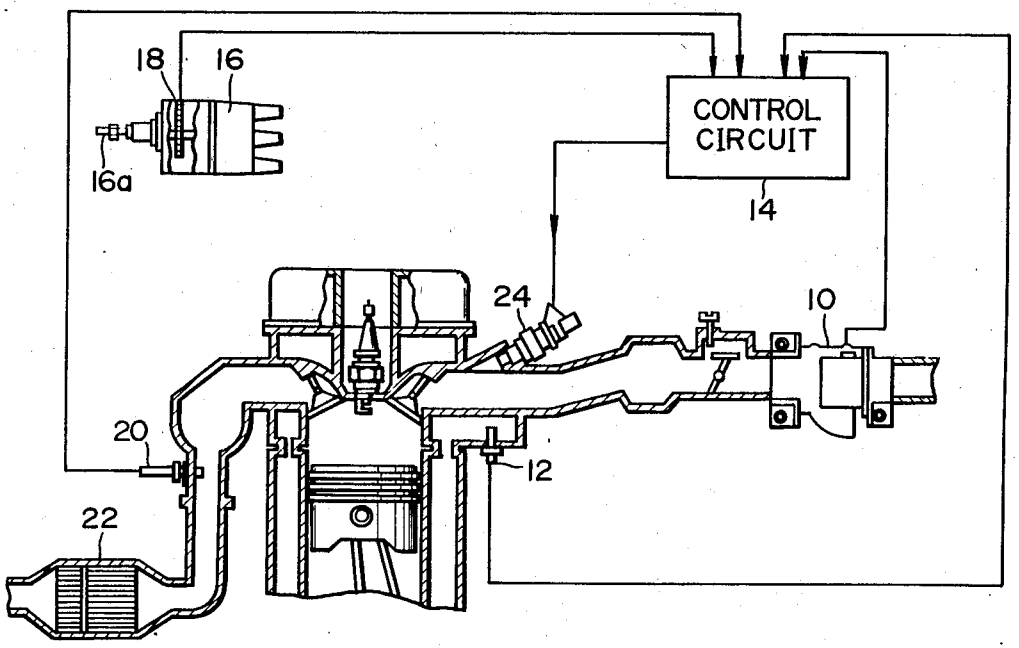
FIG. 1 is a schematic view of an embodiment of the present invention.

FIG. 1 schematically shows an example of an internal combustion engine in which fuel injection is controlled by a microcomputer as an embodiment of the present invention. In the figure, reference numeral 10 indicates an air flow sensor for detecting the intake air flow of the engine and generating a voltage corresponding to that detected flow, and 12 a water temperature sensor for detecting the coolant water temperature of the engine and generating a voltage corresponding to that detected value. The output voltages of the air flow sensor 10 and the water temperature sensor 12 are sent to a control circuit 14.

A distributor 16 of the engine is provided with a crank angle sensor 18 for generating an angular position signal each time a distributor shaft 16*a* rotates at a predetermined angle, for example, 30°, converted to crank angle. The angular position signal from this crank angle sensor is sent to the control circuit 14.

The exhaust system of the engine is provided with an $O_2$ sensor 20 which generates output in accordance with the oxygen concentration in the exhaust gas body, i.e., generates mutually different binary output voltages in accordance with whether or not the air-fuel ratio is on the lean side of the stoichiometric air-fuel ratio. This output voltage is sent to the control circuit 14. A 3-way catalytic is provided downstream of the $O_2$ sensor 20 converter 22.

An injection signal is sent to fuel injection valves 24 from the control circuit 14. This signal causes the fuel injection valves 24 to inject, in the intake system, pressurized fuel from the fuel supply system (not shown).

Figure 2:
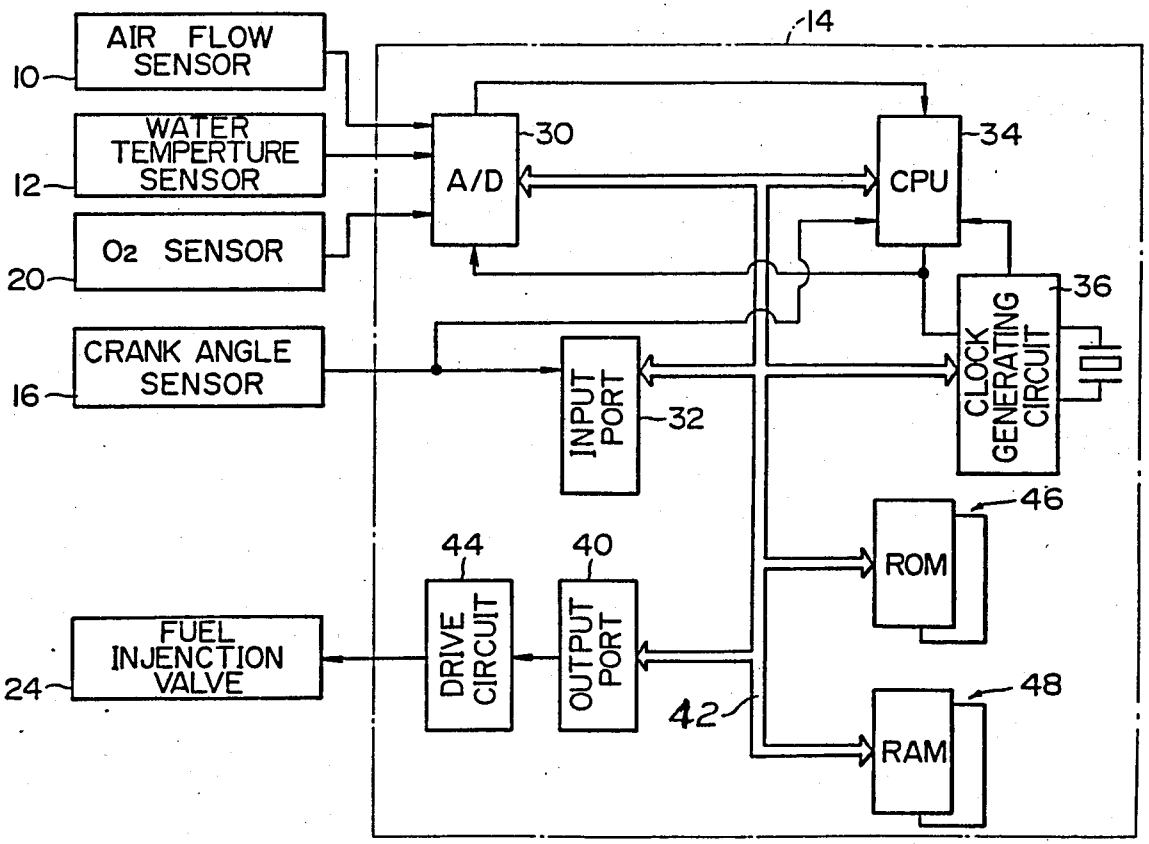
FIG. 2 is a block diagram of the control circuit of FIG. 1.

FIG. 2 is a block diagram showing an example of the control circuit 14 of FIG. 1.

The output voltages of the air flow sensor 10, the water temperature sensor 12, and the $O_2$ sensor 20 are sent to an A/D converter 30, which includes an analog multiplexer, and are converted into digital data successively or by specified order at predetermined conversion periods.

The angular positional signal of each 30° crank angle from the crank angle sensor 18 is sent to an input port 32 and further sent as a crank angle synchronous interruption signal to a central processing unit (CPU) 34.

When a predetermined bit position of an output port 40 is supplied from the CPU 34 via a bus 42 with an injection signal of a sustained period equal to an injection pulse width TAU, this signal is sent via a drive circuit 44 to the fuel injection valves 26. As a result, the injection valves 24 are energized for the period of the above-mentioned injection pulse width TAU.

The A/D converter 30, input port 32, and output port 40 are connected to the constituent elements of the microcomputer, i.e., the CPU 34, read only memory (ROM) 46, random access memory (RAM) 48, and clock generating circuit 36, via a bus 42. Transmission of the input and output data is performed via this bus 42.

Incidentally, while not shown in FIG. 2, an input and output control circuit, memory control circuit, etc. are provided by a known method such as a microcomputer.

Within the ROM 46 are stored in advance programs such as a main processing routine program, explained later, and various data, constants, etc. necessary for such computation processing.

The CPU 34 issues instructions to start A/D conversion at predetermined time intervals to the A/D converter 30. These instructions cause the outputs of the air flow sensor 10, the water temperature sensor 12, and the $O_2$ sensor 20 to be successively A/D converted and stored in predetermined positions of the RAM 48.

Interruptions are caused by the pulse at each 30° crank angle from the crank angle sensor 18 and, at each such interruption, the value of a free run counter is read and the difference between the previous value and the current value is calculated. This difference corresponds to the time required for the crankshaft to rotate 30°, and inversely, corresponds to the rotational speed of the engine. The rotational speed obtained in this way is stored at a predetermined position in the RAM 48.

Figure 3:
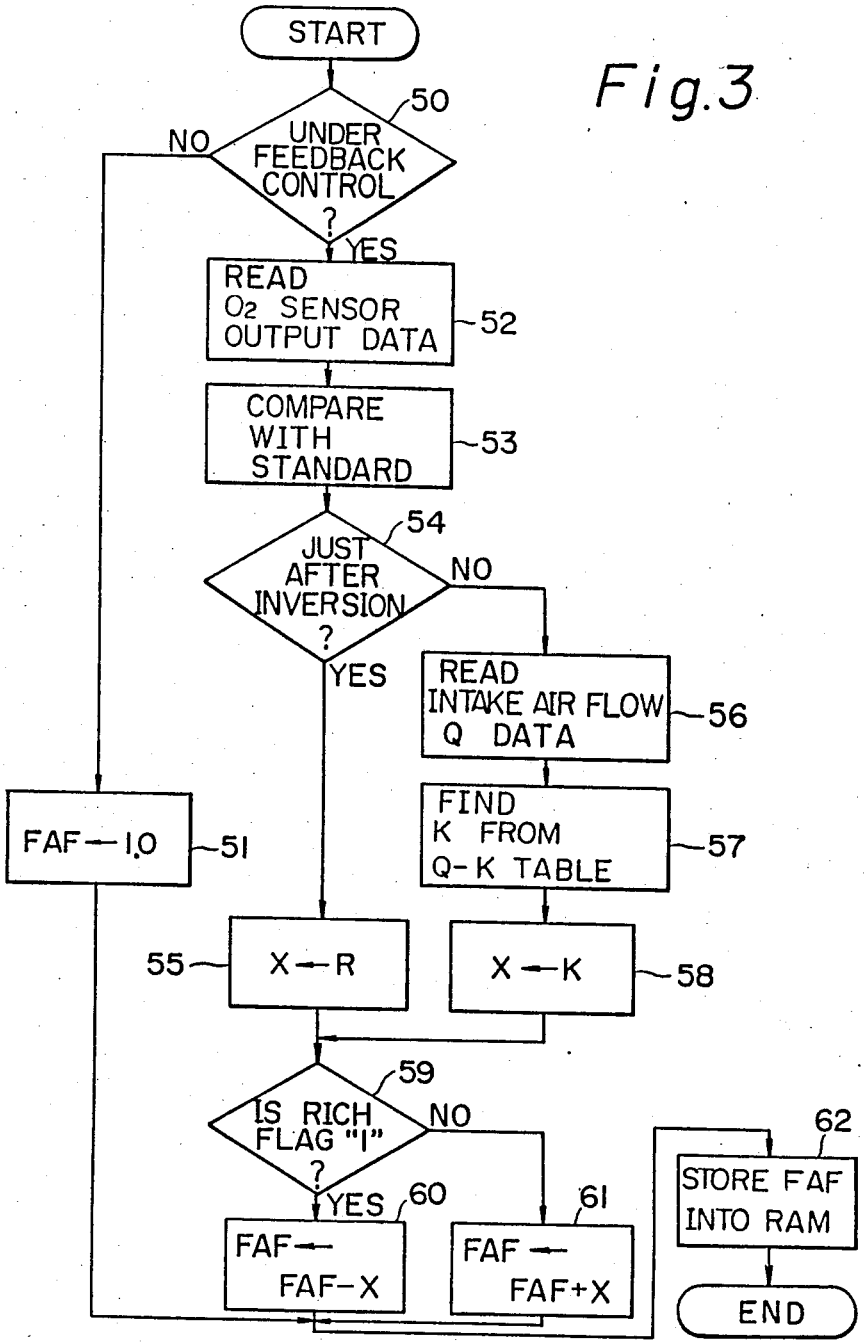
FIG. 3 and FIG. 4 are flow charts of part of a control program in the embodiment of FIG. 1.
Figure 4:
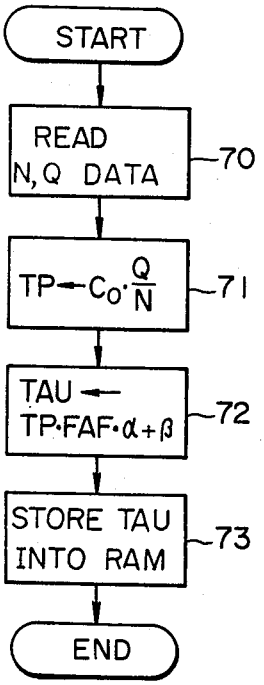

Next, the flow charts of FIG. 3 and FIG. 4 will be used to explain the control of the air-fuel ratio of this embodiment.

FIG. 3 is a processing flow chart for calculating an air-fuel ratio feedback correction coefficient FAF. The CPU 34 executes this processing routine at predetermined time intervals.

First, at step 50, it is judged whether the air-fuel ratio is under feedback control (closed loop control). For example, when the temperature detected by the water temperature sensor 12 is lower than a predetermined temperature (during warmup), feedback control is not performed. In this case, the routine advances to step 51, where the correction coefficient is set as FAF=0.1, and the routine advances to step 62, where FAF is stored in the RAM 48. The processing routine of FIG. 3 then comes to an end.

If the air-fuel ratio is under feedback control, the routine advances to step 52, where the input data corresponding to the output of the $O_2$ sensor is read from the RAM 48. At step 53, this input data is compared with a comparative standard to judge whether the oxygen concentration in the exhaust gas is lower than the value corresponding to the stoichiometric air-fuel ratio, i.e., whether the air-fuel ratio of the engine is on the rich side or the lean side of the stoichiometric air-fuel ratio. If on the lean side, the rich flag is made "1", and if on the lean side, the flag is made "0".

At the next step 54, it is judged whether the rich flag has just been reversed from "1" to "0", or vice versa. If just after reversal, the routine advances to step 55 to increase the change of the correction coefficient FAF, and a predetermined value R far larger than the integration constant K found at step 57 is inserted in X (skip processing). Incidentally, the processing of the above-mentioned steps 52 to 54 also may be performed by a routine separate from that of FIG. 3.

Figure 5:
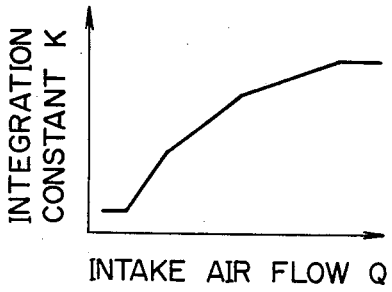
FIG. 5 is a graph of the Q-K function table.

If not directly after reversal (timing of skip processing), the routine advances to step 56, where the input data of the intake air flow Q is read from the RAM 48. Next, at step 57, the integration constant K corresponding to this Q is determined. The ROM 46 has a function table of functions of K against Q prepared in it beforehand, as shown in FIG. 5. At step 57, the value of K as opposed to Q is determined by interpolation, etc. This table includes functions wherein K is small when the intake air flow Q is low, and K increases with greater amounts of Q. At the next step 58, the determined K is inserted in X.

At the next step 59, it is judged whether the rich flag determined at step 53 is "1". If "1", the routine advances to step 60, wherein the computation FTF<-FAF−X is carried out. If "0", the routine advances to step 61, wherein FAF<−FAF+X is carried out. Specifically, when the air-fuel ratio is rich, FAF is reduced, and when it is lean, FAF is increased.

Next, at step 62, the calculated FAF is stored in the RAM 48, whereupon this processing routine comes to an end.

The following processing routine shown in FIG. 4 is executed by the CPU 34 at every predetermined crank angle or during a main routine.

First, at step 70, input data concerning the intake air flow Q and the rotational speed N from the RAM 48 are read. At step 71, the basic injection pulse width TP of the fuel injection valves 24 is calculated from the following formula:

$$TP = Co \cdot Q/N$$

where, Co is a constant.

Next, at step 72, the final injection pulse width TAU is calculated by the following formula using the air-fuel ratio feedback correction coefficient FAF calculated at the processing routine of FIG. 3 and other correction coefficients $\alpha$ and $\beta$.

$$TAU = TP \cdot FAF \cdot \alpha + \beta$$

Next, at step 73, the TAU calculated in this way is stored in the RAM 48. This TAU is read out in the fuel injection processing routine, is converted to an injection signal, and is sent to the output port 40.

According to the embodiment described above, the integration constant K of the air-fuel ratio feedback correction coefficient FAF is controlled in accordance with the intake air flow Q as shown in FIG. 5, i.e., controlled so that when Q increases, K becomes larger, and when Q decreases, K also decreases.

Figure 6:
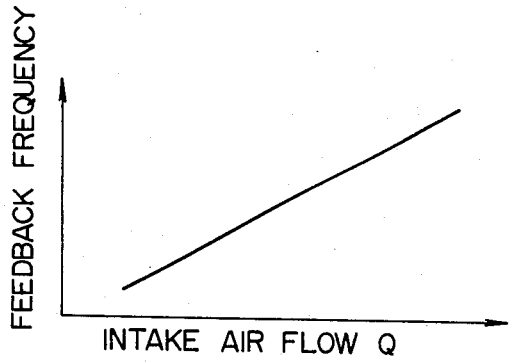
FIG. 6 is a graph of the relationship between the intake air flow and feedback coefficient.
Figure 7:
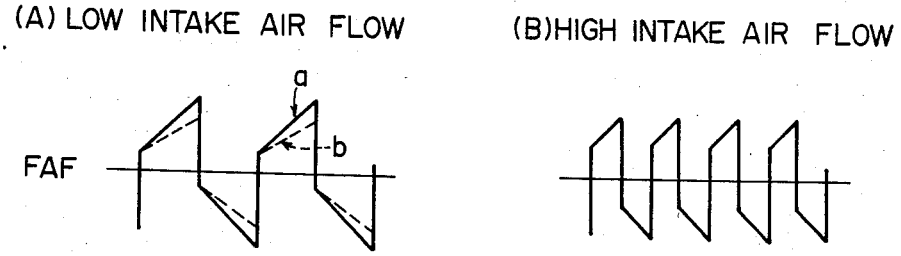
FIGS. 7(A) and (B) are waveform diagrams of the air-fuel feedback correction coefficient.
Figure 8:
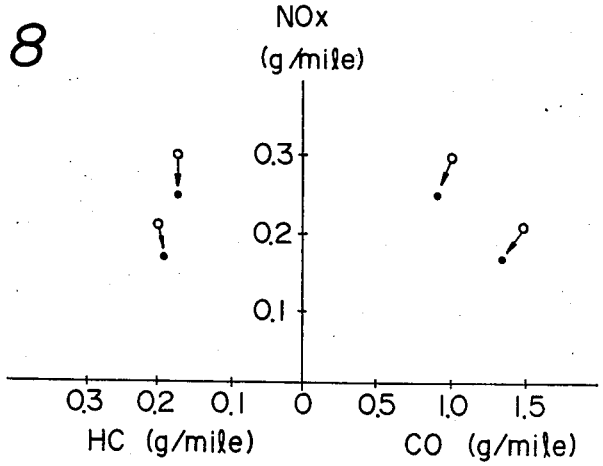
FIG. 8 is a view for explaining the improvement in the cleaning performance due to the processing routine of FIG. 3.

In general, the intake air flow Q and the FAF frequency (feedback frequency) have the relationship shown in FIG. 6. The waveform of FAF, in the case of a low air flow, is as shown by the solid line a in FIG. 7(A) and, in the case of a high air flow, as shown by FIG. 7(B). Specifically, in the case of a low air flow, the frequency becomes lower and, therefore, the amplitude of the FAF becomes greater than in the case of a high air flow. However, since the integration constant K becomes smaller in the case of a low air flow, as in the present embodiment, the gradient of the integer of the FAF becomes gentle, as shown by the broken line b of FIG. 7(A) and the amplitude can be controlled in the same way as with the case of a high air flow. Specifically, the amplitude can be maintained at a predetermined value regardless of the running conditions. As a result, the cleaning performance of the catalytic converter can be maintained at its maximum level. FIG. 8 shows experimental findings indicating the improvement of the cleaning performance of catalystics due to the present embodiment. The HC, $NO_x$, and CO components in the exhaust gas all fall considerably from the white circles of the prior art to the black circles of the present embodiment.

Figure 9:
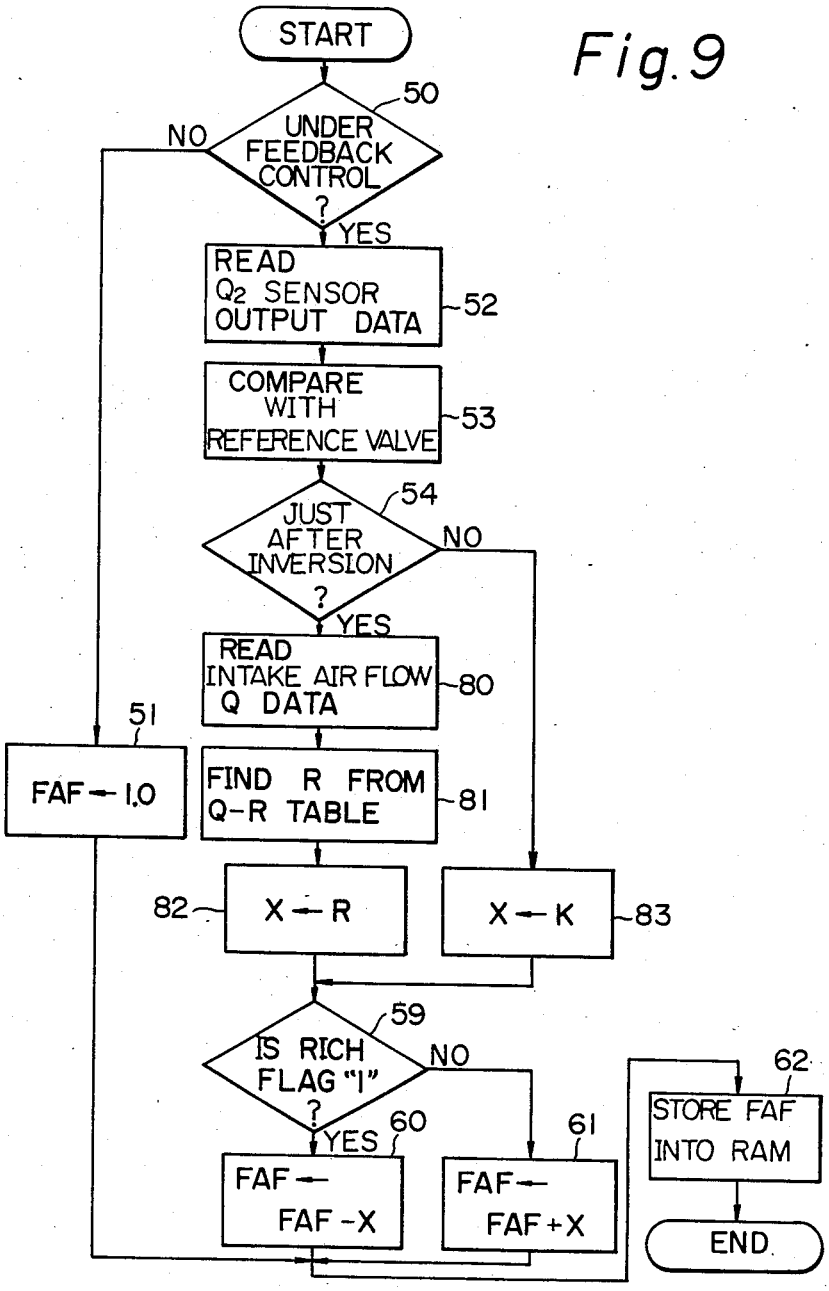
FIG. 9 is a flow chart of part of the control program in another embodiment of the present invention.

FIG. 9 shows the processing routine for calculating FAF in another embodiment of the present invention.

Figure 10:
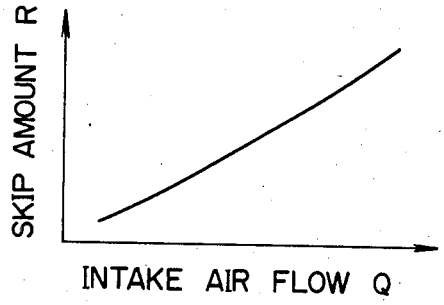
FIG. 10 is a graph of the Q-R function table.

This processing routine makes the amount of skip R of the FAF variable in accordance with the intake air flow Q. In place of steps 55 to 58 of the processing routine of FIG. 3, steps 80 to 83 are provided. When it is judged at step 54 that inversion has just occurred, the routine advances to step 80, where the input data of the intake air flow Q is read from the RAM 48. Next, at step 81, the skip amount R corresponding to this Q is determined. The ROM 46 has a function table of functions as shown in FIG. 10 of R against Q prepared in it in advance. At step 81, the R against the Q is determined using interpolation, etc. Next, at step 82, the determined R is inserted in X. On the other hand, when it is judged at step 54 that inversion has not just occurred, the routine advances to step 83 and an integration constant K of a predetermined value is inserted in X.

According to the present embodiment, the skip amount R of the FAF is controlled in such a manner that it will increase with an increase in Q and decrease with a decrease in Q. As a result, in the case of a low air flow, it is controlled in the direction decreasing the amplitude and, in the case of a high air flow, in the opposite direction. Accordingly, the FAF amplitude can be maintained at a predetermined level regardless of the running conditions, and thus the same effects as shown in FIG. 3 can be obtained.

Figure 11:
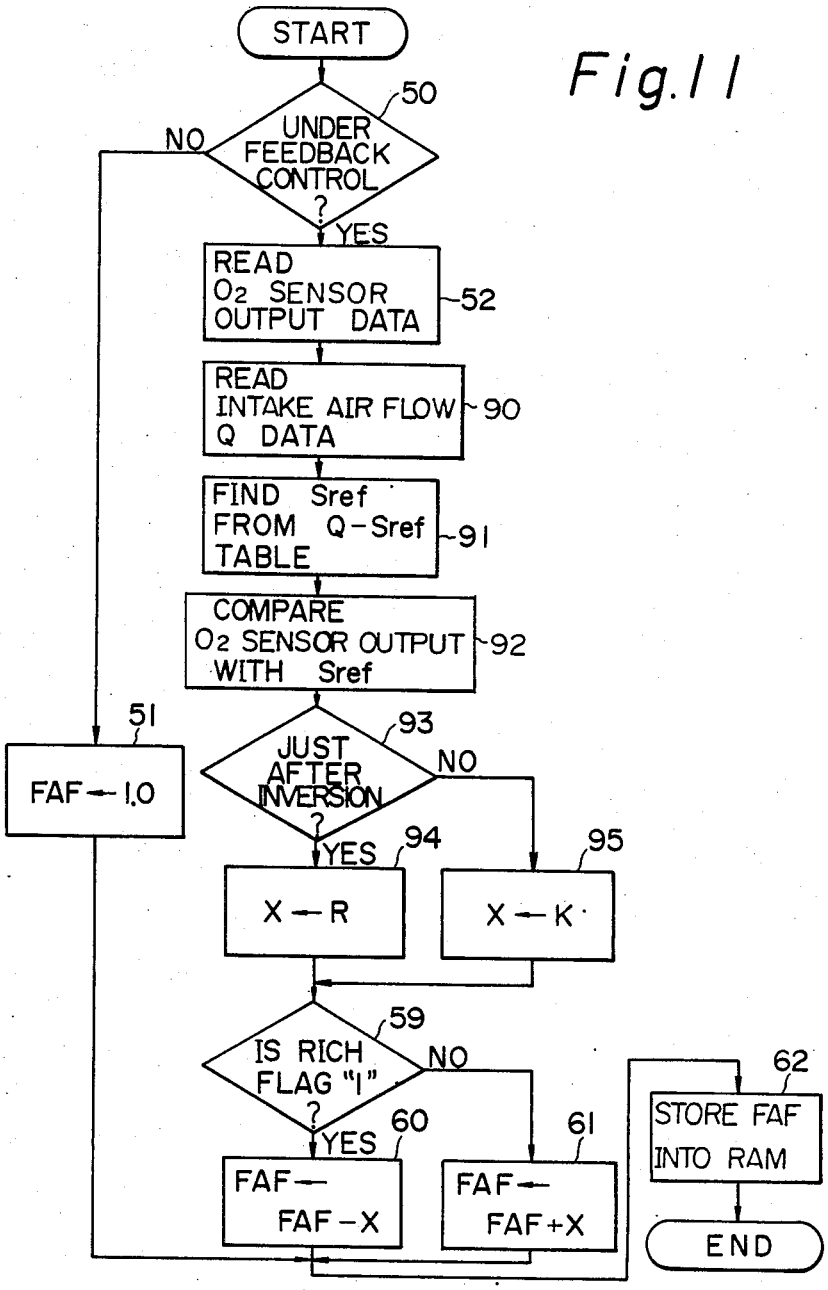
FIG. 11 is a flow chart of part of a control program in still another embodiment of the present invention.

FIG. 11 shows the processing routine for calculating FAF in still another embodiment of the present invention.

Figure 12:
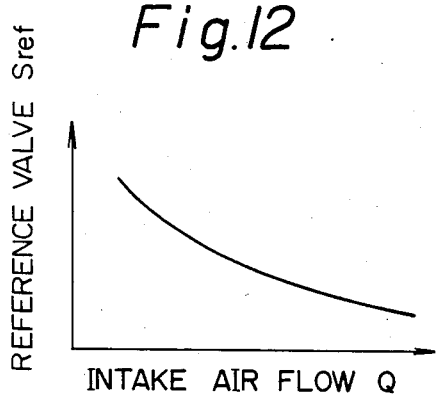
FIG. 12 is a graph of the Q-Sref function table.

In this processing routine the comparative standard Sref of the data of the $Q_2$ sensor output is made variable in accordance with the intake air flow, and steps 80 to 95 replace steps 53 to 58 of the processing routine of FIG. 3. After the input data corresponding to the output of the $O_2$ sensor 20 is read out from the RAM 48 at step 52, the input data of the intake air flow Q is read out from the RAM 48 at step 90. Next, at step 91, the comparative standard Sref corresponding to this Q is determined. The ROM 46 has a function table of the functions (as shown in FIG. 12) of Sref against Q prepared in it in advance. At step 91, the Sref against the Q is determilned by interpolation, etc. Next, at step 92, the input data of the $O_2$ sensor output and this comparative standard Sref are compared and a rich flag prepared. At the next step 93, it is judged whether the rich flag has just inverted. If it has just inverted, a predetermined skip amount R is inserted in X at step 95. If it has not just inverted, a predetermined interpolation constant K is inserted in X at step 95.

Figure 13:
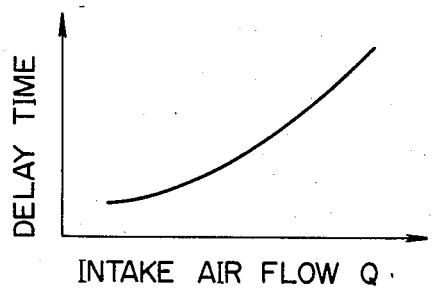
FIG. 13 is a graph of the relation between the intake air flow and the $O_2$ sensor output delay time.

According to the present embodiment, the comparative standard Sref for comparison with the $O_2$ sensor output is controlled in such an manner that it decreases with an increase in Q and increases with a decrease in Q. As a result, in the case of a low air flow, it is controlled in the direction of a high frequency of FAF and, in the case of a high air flow, in the direction of a low frequency. As a result, the frequency, and thus the amplitude, of FAF can be maintained at a predetermined level regardless of the running conditions, and thus the same effects as shown in FIG. 3 can be obtained. Incidentally, in place of the comparative standard Sref, the delay time of the $O_2$ sensor output can be controlled as in FIG. 13 in accordance with the intake air flow Q so as to obtain the same effects as shown by this embodiment.

As explained above, according to the present invention, at least one of the amplitude and frequency of the air-fuel ratio feedback correction coefficient is controlled in accordance with the intake air flow, and therefore, it is possible to obtain the maximum cleaning performance of a catalystic converter under all running conditions.

Many widely different embodiments of the present invention may be constructed without departing from the spirit and scope of the present invention. It should be understood that the present invention is not limited to the specific embodiments described in this specification, except as defined in the appended claims.

I claim:

1. A fuel injection control apparatus for an internal combustion engine comprising:

means for detecting a concentration of a specific component of an engine exhaust gas;

means for calculating at predetermined intervals of time an air-fuel ratio feedback correction coefficient in accordance with the detected concentration of the specific component, said calculating means including means for integrating the detected concentration of the specific component with respect to time by using an integration constant;

means for detecting an intake air flow of the engine; and means for selecting the integration constant, in accordance with the detected intake air flow, so that at least the envelope of a correction signal based on a plurality of feedback correction coefficients has an amplitude that is constant even if the intake air flow rate is changed.

2. An apparatus as claimed in claim 1, wherein said integration constant is a value obtained from a Q-K function table corresponding to intake air flow.

3. An apparatus as claimed in claim 2, wherein said integration constant increases with greater amounts of the intake air flow, and an increment rate of the integration constant corresponding to that of the intake air flow is set so as to decrease with the greater amounts of the intake air flow.

* * * * *